US012098508B2

(12) United States Patent
Moshasha et al.

(10) Patent No.: US 12,098,508 B2
(45) Date of Patent: Sep. 24, 2024

(54) CELLULOSIC FIBER ADDITIVE FORMED FROM KOMBUCHA BIOFILMS

(71) Applicants: Shaun Moshasha, Charlottesville, VA (US); Cutter Grathwohl, Charlottesville, VA (US); James Mahoney, Charlottesville, VA (US)

(72) Inventors: Shaun Moshasha, Charlottesville, VA (US); Cutter Grathwohl, Charlottesville, VA (US); James Mahoney, Charlottesville, VA (US)

( * ) Notice: Subject to any disclaimer, the term of this patent is extended or adjusted under 35 U.S.C. 154(b) by 120 days.

(21) Appl. No.: 17/346,532

(22) Filed: Jun. 14, 2021

(65) Prior Publication Data

US 2021/0301471 A1 Sep. 30, 2021

Related U.S. Application Data

(63) Continuation-in-part of application No. 16/159,556, filed on Oct. 12, 2018, now Pat. No. 11,033,050.

(60) Provisional application No. 62/572,155, filed on Oct. 13, 2017.

(51) Int. Cl.

| | |
|---|---|
| ***D21H 17/25*** | (2006.01) |
| ***D21H 17/15*** | (2006.01) |
| ***D21H 19/52*** | (2006.01) |
| ***D21H 21/10*** | (2006.01) |
| ***D21H 21/18*** | (2006.01) |

(52) U.S. Cl.

CPC ..... *D21H 17/25* (2013.01); *D21H 17/15* (2013.01); *D21H 19/52* (2013.01); *D21H 21/10* (2013.01); *D21H 21/18* (2013.01)

(58) Field of Classification Search

CPC ..... D21H 17/25; D21H 17/15; D21H 19/52; D21H 21/10; A24D 1/02; A24D 1/002; A24D 1/022; A24D 1/00; B32B 29/00; B32B 7/06; C12N 1/20; C12N 1/14; D21C 5/005

See application file for complete search history.

(56) References Cited

U.S. PATENT DOCUMENTS

| | | | | |
|---|---|---|---|---|
| 4,863,565 | A | 9/1989 | Johnson et al. | |
| 5,060,675 | A | 10/1991 | Milford et al. | |
| 6,470,894 | B2 | 10/2002 | Hersh et al. | |
| 9,532,589 | B2 * | 1/2017 | Skripitsyna | C12G 3/021 |
| 11,033,050 | B2 * | 6/2021 | Moshasha | A24D 1/002 |

(Continued)

FOREIGN PATENT DOCUMENTS

| | | | |
|---|---|---|---|
| CN | 101756883 | A | 6/2010 |
| CN | 102475354 | A | 5/2012 |

(Continued)

OTHER PUBLICATIONS

Pilla in "Handbook of Bioplastic and Biocomposites Engineering Applications," Scrivener Publishing & John Wiley & Sons, Inc., pp. 397-449. (Year: 2011).*

(Continued)

*Primary Examiner* — Jose A Fortuna
(74) *Attorney, Agent, or Firm* — Woods Rogers Vandeventer Black PLC; Nathan A. Evans

(57) ABSTRACT

Application of KBC as a unique form of and source of nano-crystalline cellulose having viability for use in place of or in conjunction with alternative fiber additives, such as for paper products and reinforced paper composites.

4 Claims, 3 Drawing Sheets

(56) References Cited

U.S. PATENT DOCUMENTS

| | | | | |
|---|---|---|---|---|
| 2006/0165643 | A1 | 7/2006 | Lintner | |
| 2015/0098906 | A1 | 4/2015 | Farrow | |
| 2015/0282523 | A1 | 10/2015 | O'Malley | |
| 2018/0042292 | A1 | 2/2018 | Valadi | |
| 2019/0174815 | A1* | 6/2019 | Moshasha | A24D 1/002 |
| 2021/0214675 | A1* | 7/2021 | Kruger | C12N 1/16 |
| 2021/0301471 | A1* | 9/2021 | Moshasha | D21H 17/25 |
| 2023/0029537 | A1* | 2/2023 | Maheshwari | H05B 3/34 |
| 2023/0052976 | A1* | 2/2023 | Brito | C12P 19/04 |

FOREIGN PATENT DOCUMENTS

| | | | | |
|---|---|---|---|---|
| CN | 104304562 | A | 1/2015 | |
| DE | 102009014165 | A1 | 9/2010 | |
| EP | 3715110 | A1 | 9/2020 | |
| GB | 2349651 | A * | 11/2000 | C08B 37/00 |
| GB | 2349571 | A | 5/2019 | |
| WO | 8912107 | A1 | 12/1989 | |
| WO | WO-2019075422 | A1 * | 4/2019 | A24D 1/002 |
| WO | WO-2022266041 | A1 * | 12/2022 | |

OTHER PUBLICATIONS

Aduri et al., Study of Biodegradable Packaging Material Produced from SCOBY, 2019 [retrieved on Jul. 28, 2022]. Retrieved from the internet: <URL: http://www.rjlbpcs.com/article-pdf-downloads/2019/28/644.pdf>. pp. 389-404.

Application No. PCT/US2022/033349, International Search Report and Written Opinion dated Sep. 2, 2022.

Park, J.K., et al., 26—Bacterial cellulose, Handbook of Hydrocolloids (Second edition), Woodhead Publishing Series In Food Science, Technology and Nutrition, 2009, pp. 724-739, (https://www.sciencedirect.com/science/article/pii/B9781845694142500266).

Bsirianni, Growing fabrics ?! (A call to collaboration), The Edge (http://edgeqld.org.au/), May 21, 2012.

Woods, Tyler, Grow your own paper (with kombucha!) at this insanely cool workshop, Technical.ly Brooklyn (https:// technical.ly/brooklyn/2017/03/14/genspace-buzzin-off-the-bucha/), Mar. 14, 2017.

Genspace, Kombucha Papermaking: Grow Your Own Paper, Edible Brooklyn (https://www.ediblebrooklyn.com/), Aug. 27, 2017.

* cited by examiner

| Material | Fiber Length (mm) | Fiber Diameter (um) | Lumen Diameter (um) | Cell Wall Thickness (um) | Slenderness ratio= (fiber length/ fiber diameter) | Flexibility Coefficient= (fiber lumen diameter) | Runkel Ratio= (2X cell wall thickness/ lumen diameter) | Ash Content (%) | Lignin Content (%) | Alpha Cellulose Content (%) |
|---|---|---|---|---|---|---|---|---|---|---|
| **Bacterial cellulose** | | | | | | | | | | |
| Kombucha SCOBY | 8.88E-05 | 9.0085 | n/a | n/a | | n/a | n/a | 0.1 | 0 | 99 |
| **Non-wood fibers (plantae)** | | | | | | | | | | |
| Hibiscus cannabinus L. (65% core- 35% bark) | 1.29 | 22.10 | 12.70 | 4.30 | 58.30 | 57.50 | 0.67 | 3.90 | 18.23 | 42.20 |
| Arundo donax L. (reed/giant grass) (culms) | 1.18 | 18.80 | 8.60 | 5.50 | 60.00 | 46.00 | | 5.33 | 18.32 | 32.43 |
| Arundo donax L. (inter- nodes) | 1.22 | 17.10 | 6.50 | 4.40 | 70.50 | 49.20 | 1.00 | 4.53 | 16.93 | 36.27 |
| Miscanthus giganteus | 0.97 | 14.20 | 8.90 | 4.10 | 68.30 | 41.30 | | 1.90 | 27.63 | 41.33 |
| Panicum virgatum L. (switchgrass) | 1.15 | 13.10 | 5.60 | 4.50 | 87.70 | 44.20 | | 7.40 | 17.40 | 41.67 |
| Gossypium hirsutum (cotton stalks) | 0.83 | 19.80 | 12.80 | 3.40 | 42.30 | 32.10 | 0.53 | 3.53 | 15.47 | 42.03 |
| Hemp (stalks) | 0.90 | 22.80 | 19.50 | 1.67 | 39.50 | | 0.17 | 1.30 | 18.23 | 46.90 |
| Hemp (woody-core) | 0.91 | 23.70 | 21.60 | 0.95 | | | 0.09 | 1.20 | 27.10 | 36.30 |
| Hemp (bast fibers) | 2.24 | 20.50 | 9.80 | 5.40 | 109.30 | 46.80 | | 1.50 | 4.03 | 71.70 |
| Brassica napus (Rapeseed stalk) | 1.20 | 13.10 | 8.60 | 2.25 | 91.00 | 64.00 | 0.56 | 5.80 | 21.53 | 39.50 |
| Saccharum officinarum (bagasse/ sugarcane) | 1.51 | 21.40 | 6.27 | 7.74 | 70.56 | 29.29 | | -- | 20.80 | 40.00 |
| Zea mays (Corn) | 0.88 | 20.12 | 10.52 | 4.59 | 44.09 | 52.33 | 0.84 | -- | 21.33 | 47.33 |
| **Hardwood fibers** | | | | | | | | | | |
| Olea europea (olive tree prunings) | 0.88 | 15.10 | 6.20 | 4.50 | 58.20 | 41.05 | | 1.90 | 19.30 | 40.17 |
| Prunus dulcis (almond tree prunings) | 0.77 | 13.10 | 4.50 | 4.40 | 58.70 | 32.90 | | 2.80 | 26.53 | 39.17 |
| Prunus domestica (plum wood branches) | 0.97 | 16.83 | 7.99 | 4.42 | 58.86 | 47.47 | | -- | 35.60 | 53.25 |
| Prunus domestica (plum wood stem) | 0.98 | 13.77 | 5.60 | 4.08 | 73.36 | 40.67 | | - | 32.03 | 51.65 |
| Eucalyptus grandis | 0.83 | 15.96 | 9.78 | 3.11 | 52.00 | 61.30 | 0.65 | -1 | 21.60 | 51.30 |
| Eucalyptus pellita | 1.02 | 18.25 | 8.94 | 3.19 | 78.21 | 52.48 | 0.57 | | 29.48 | 49.02 |
| Elaeis guineensis (Oil palm frond) | 0.29 | 11.00 | 6.03 | 1.98 | | 36.58 | 0.57 | 2.40 | 20.48 | 56.03 |
| Elaeis guineensis (Oil palm trunk) | 0.57 | | 11.50 | 6.00 | 38.75 | 53.26 | | 2.20 | 24.51 | 41.02 |
| Paulownia fortunei | 1.00 | 35.44 | 26.49 | 6.47 | | 74.73 | 0.49 | -- | -- | -- |
| Paulownia elongata | 1.06 | 38.55 | 26.30 | 5.25 | 32.00 | | 0.40 | -- | -- | -- |
| Green Paulownia (fortunei x elongata) | 0.91 | 34.59 | 26.80 | 3.89 | | | 0.35 | -- | -- | -- |
| Musa paradisiaca (Musa acuminata x musa balbisiana) (bananas tree) | 1.55 | 22.00 | 14.20 | 5.50 | 70.50 | 64.55 | 0.77 | | 18.21 | 59.18 |
| **Softwood Fibers** | | | | | | | | | | |
| Pinus radiata (Monterey pine) | 3.13 | 34.23 | 20.55 | 6.85 | 91.40 | | 0.67 | -- | 27.20 | 37.40 |
| Pinus sylvestris (scots pine) | 2.15 | 30.10 | 15.50 | 2.26 | 64.60 | 36.60 | 0.28 | 0.60 | 27.70 | 40.00 |
| Pinus contorta (lodepole pine) | 2.23 | 31.70 | 14.80 | 2.30 | 70.40 | 46.60 | 0.31 | 0.80 | 26.40 | 49.00 |
| Pinus taeda (southern pine rootwood) | 3.99 | 52.48 | 41.68 | 5.40 | 76.00 | | 0.26 | -- | -- | -- |
| Pinus taeda (southern pine stemwood) | 2.97 | 36.75 | 25.66 | 6.55 | 78.60 | 36.46 | 0.51 | -- | -- | -- |
| Picea abies (Norway spruce) | 2.70 | 37.00 | 23.00 | 2.20 | 72.97 | 62.16 | 0.19 | -- | 27.40 | 41.70 |
| Larix sibirica (Siberian Larch) | -- | 20.00 | 10.20 | 5.10 | -- | 51.00 | 1.00 | -- | 28.80 | 41.40 |
| Larix decidua (European Larch) | 2.19 | 34.80 | -- | -- | 63.80 | -- | -- | 0.60 | 31.20 | 45.50 |
| **Bamboos** | | | | | | | | | | |
| Oligostachyum lepus | 2.54 | 14.54 | 6.12 | 4.21 | 160.94 | 42.09 | | 0.69 | 22.41 | 47.06 |
| Dendrocalamus asper | 3.24 | 21.30 | 9.77 | 5.77 | 152.11 | 45.67 | | 2.13 | 25.27 | 40.60 |
| Oxytenanthera robusta | 1.90 | 25.22 | 9.91 | 6.16 | 85.51 | 44.03 | | 1.68 | 23.96 | 44.30 |
| Dendrocalamus giganteus | 2.73 | 31.34 | 10.31 | 5.92 | 130.17 | 46.31 | | 3.70 | 23.56 | 46.86 |
| Bambusa arundinaria | 1.73 | 32.00 | 6.05 | 8.00 | 78.64 | 27.27 | | 2.70 | 24.60 | 58.80 |
| Bambusa blumeana | 2.02 | 18.00 | 4.00 | 7.00 | 112.22 | 27.22 | | -- | -- | -- |
| Bambusa vulgaris | 2.33 | 17.00 | 4.00 | 7.00 | 137.06 | 23.53 | | -- | -- | -- |
| Bambusa tuldo | 1.89 | 17.00 | 3.45 | 6.78 | 111.20 | 20.29 | | -- | 26.70 | 47.00 |
| gigantochloa aspera | 3.78 | 19.00 | 7.00 | 6.00 | 199.95 | 36.84 | | -- | -- | -- |
| dendrocalamus hamilton | 1.76 | 19.00 | 6.00 | 6.50 | 97.09 | 31.58 | | -- | -- | -- |
| schizostachyum lima | 1.67 | 22.00 | 4.00 | 9.00 | 75.91 | 18.18 | | -- | -- | -- |
| schizostachyum lumampao | 2.42 | 14.00 | 6.00 | 4.00 | 172.86 | 42.86 | | -- | -- | -- |
| **Aquatic plant fibers** | | | | | | | | | | |
| Cyperus digitatus | 0.72 | 9.64 | 3.15 | 3.25 | 76.83 | 32.67 | | -- | -- | -- |
| Cyperus rotundus | 0.71 | 9.13 | 4.32 | 2.41 | 81.57 | 36.63 | | -- | 9.54 | 42.19 |
| Cyperus haspan | 0.73 | 11.08 | 6.92 | 2.58 | 69.01 | 62.43 | | -- | -- | -- |
| Scirpus grossus (Giant bulrush) | 0.93 | 12.11 | 7.30 | 2.41 | 73.77 | 26.58 | 0.54 | -- | 13.43 | 36.23 |
| Typha angustifolia (narrowleaf cattail) | 0.83 | 10.04 | 4.35 | 2.85 | 83.34 | 42.52 | | -- | 20.54 | 44.06 |
| Eichhornia crassipes (water hyacinth) | 1.80 | 5.50 | 3.00 | 2.50 | 250.30 | | 0.56 | -- | - | -- |
| Exploration Scheme (based on pulp/paper industry standards, though these can be broaden) | | | | | | | | | | |
| | | | | | Suitable | Slightly Rigid (>50) | Suitable | | | |
| | | | | | | Rigid (>0.50) | | | | |
| | | | | | | Highly Rigid | | | | |

FIG. 1

| | 100% Kraft | | 50% Kraft | | 40% Kraft | | 30% Kraft | | 20% Kraft | | 0% Kraft | |
|---|---|---|---|---|---|---|---|---|---|---|---|---|
| | GSM ($g/m^2$) | Tensile (N) | GSM ($g/m^2$) | Tensile (N) | GSM ($g/m^2$) | Tensile (N) | GSM ($g/m^2$) | Tensile (N) | GSM ($g/m^2$) | Tensile (N) | GSM ($g/m^2$) | Tensile (N) |
| AVG | 106.56271 | 33.013 | 113.343977 | 27.382 | 110.631471 | 25.197 | 125.937752 | 24.098 | 102.68771 | 19.009 | 106.75646 | 9.84 |
| STD | 11.660848 | 7.48912 | 14.2156989 | 5.7530066 | 16.2475871 | 3.30410536 | 12.7542119 | 4.05737134 | 11.223409 | 2.8736019 | 14.683331 | 3.14094112 |
| | | | | | | | | | | | | |
| w/ 2% BC | | | 48% Kraft | | 38% Kraft | | 28% Kraft | | 18% Kraft | | | |
| | | | GSM ($g/m^2$) | Tensile (N) | GSM ($g/m^2$) | Tensile (N) | GSM ($g/m^2$) | Tensile (N) | GSM ($g/m^2$) | Tensile (N) | | |
| AVG | | | 117.606485 | 34.52 | 125.937752 | 33.505 | 117.412735 | 29.249 | 100.55645 | 21.814 | | |
| STD | | | 14.5578058 | 6.932532 | 11.1488342 | 9.5336215 | 15.0688595 | 8.39438099 | 14.683331 | 4.683131 | | |

Average GSM = 112.743 +/- 15.6308

FIG. 2A

CELLULOSIC FIBER ADDITIVE FORMED FROM KOMBUCHA BIOFILMS

CROSS-REFERENCE TO RELATED APPLICATIONS

This application is a continuation-in-part and relies on the disclosures of and claims priority to and the benefit of the filing dates of U.S. patent application Ser. No. 16/159,556 filed Oct. 12, 2018 and U.S. Provisional Application No. 62/572,155 filed Oct. 13, 2017, the disclosures of which are hereby incorporated by reference in their entireties.

BACKGROUND OF THE INVENTION

Field of the Invention

The present invention relates to the production and use of specialty cellulose and cellulose derivatives using the SCOBY (Symbiotic Colony of Bacteria and Yeast) produced as the side stream of Kombucha fermentation.

Description of Related Art

Cellulose strands are essentially packages of microfibrils, which are each individual packages of elementary fibrils which are nano-scale fiber units. The manufacturing of cellulose is an ancient practice that has been well documented and industrialized; it is only in recent years however (e.g., the 21st century) that plant-based cellulose has been purposefully microfibrillated. Different high value cellulosic derivatives made from digested wood pulp have been developed. Some of the cellulose derivatives that can be made from digested wood pulp include but are not limited to Cellulose nanocrystals (CNC), nanofibrillated cellulose (NFC), microfibrillated cellulose (MFC), nanocellulose (NC), dissolving cellulose, and regenerated cellulose, all of which are herein generally referred to as Cellulose Derivatives.

Traditional plant matrices from which cellulose is derived form complex intercalated networks with molecules like lignin, hemicellulose, and pectin. The purification of the cellulose by the removal of those other biomolecules, followed by the subsequent nano fibrillation of the cellulose to obtain nanocellulose and other cellulose derivatives, is water, chemical, and energy intensive. A tree or other plant based material must be ground down into chips and chemically and mechanically digested in order to remove lignin, hemicellulose and other materials to isolate alpha-cellulose. That alpha-cellulose must then go through multiple rounds of high-pressure, energy intensive processing. Therefore, traditional production of nanocellulose and other Cellulose Derivatives is cost-prohibitive for industrial applications.

Art pertaining to bacterial cellulose ("BC") and microfibrillated cellulose "(MFC") exists, such as bacterial cellulose based 'green' composites (see, e.g., U.S. Patent Publication No. 2014/0083327), but the specific use of Kombucha-derived Bacterial Cellulose ("KBC") in whole or as a fiber additive with respect to any of the applications as described herein is new and non-obvious.

Stora Enso holds a large number of patents for various methodologies of producing MFC and claims to employ an MFC additive in a portion of a commercial paper products. Stora Enso also includes in some of its patents that its MFC can be used for "Fibrous materials such as filaments or mats, and polymer composites comprising such materials are also described" (see, e.g., U.S. Patent Publication No. 2020/0339783). Stora Enso also holds a patent for use of MFC as a surface coating on cardboard (see U.S. Patent Publication No. 2020/0171796) though it is worth noting that this patent neither mentions MFC from KBC, which is quite distinct from synthesized MFC from plant fiber, nor the use of the MFC as a fiber additive; instead this patent describes a "packaging material comprising a layer of microfibrillated cellulose (MFC) and an aluminum layer . . . wherein that layer comprising MFC and/or the aluminum layer has been laminated or extrusion coated on at least one side with a thermoplastic polymer." The use of bacterial cellulose as a cosmetic additive has not yet been practiced on a commercial scale although since 2017, numerous patents have been filed toward the pursuit.

However, the specific use of and practice of using KBC in whole or as an additive (e.g., fiber additive) to any of the applications as described herein is new and non-obvious. KBC represents a unique form of and source of nano-crystalline cellulose with viability for use in place of or in conjunction with alternative fiber additives, including but not limited to paper products and reinforced paper composites.

SUMMARY OF THE INVENTION

An object of the present invention is to use KBC as a unique form of and source of nano-crystalline cellulose having viability for use in place of or in conjunction with alternative fiber additives, such as for paper products and reinforced paper composites.

Kombucha is the name for a fermented tea that has been popular in many cultures throughout the eastern hemisphere for thousands of years. These cultures claim a significant health benefit to be gained by drinking Kombucha, namely due to the high nutritional content and probiotic activity of the beverage. The name of the beverage in many cultures translates into "tea fungus" or "tea mushroom" due to the growth of a gelatinous biofilm (also known as a pellicle) at the liquid-gas interface. The biofilm is not a mushroom, but instead is what is known as a SCOBY, or a Symbiotic Colony of Bacteria and Yeast. While the microbial makeup of the SCOBY varies depending on the source of the culture, some of the more persistent organisms contained within Kombucha include *Saccharomyces* and *Gluconacetobacter xylinus*.

The Kombucha bacterial culture is a symbiotic colony comprising at least *Gluconacetobacter xylinus*. Other microorganisms contained in the culture may include, but are not limited to any yeasts, including *Saccharomyces cerevisiae*, Brettanomyces bruxellensis, *Candida stellata, Schizosaccharomyces pombe*, and *Zygosaccharomyces bailii* and any other microorganism derived from the genera *Acetobacter, Azotobacter, Rhizobium, Agrobacterium, Pseudomonas, Gluconacetobacter, Alcaligenes, Lactobacillus, Lactococcus, Leuconostoc, Bifidobacterium, Thermus*, Allobaculum, Ruminococcaceae, Incertae Sedis, *Enterococcus, Salmonella*, Sarcina, and *Propionibacterium*.

KBC is chemically pure (or near pure) cellulose, free from any other biopolymers such as lignin, hemicellulose, and pectin. KBC has a high degree of crystallinity and fibers that already exist on the micro and nano scale. The inventors have determined that the industrial production of KBC offers a sustainable, affordable, high purity and environmentally friendly alternative to wood for the production of Cellulose Derivatives. Further, as determined by the inventors, novel and unique growth methods of KBC allow for the production of specialty cellulose that can be processed directly rather than be converted to Cellulose Derivatives. The use of KBC as described herein would thus be commercially, economically and environmentally beneficial and promote the development of the circular economy. Accordingly, it is an object of the present invention to establish industrial production of KBC in order to offer a sustainable, affordable, high purity and environmentally friendly alternative to wood for the production of Cellulose Derivatives. Further, it is an object of the current invention to provide novel and unique growth methods of KBC in order to allow for the production of specialty cellulose that can be processed directly rather than be converted to Cellulose Derivatives.

The manufacturing of KBC and Cellulose Derivatives, however, is non-trivial. KBC has particularly high water retentivity due to the microscopic scale of its fiber. This leads to production complications when incorporating KBC in large scale manufacturing due to long drainage times in the paper formation stage, for example. As a result of its unique drainage properties, KBC, while structurally preferable to plant-based cellulose according to the present invention, is typically considered to be not commercially viable to produce, including by those skilled in the art of cellulosic fiber manufacturing. Complications in manufacturing products that include or are made entirely of KBC arise due to water retentivity, unique dimensions of KBC fibers, difficulty of the fibers to disperse evenly in plant-based cellulose, and difficulty to analyze the quality and dispersion of the fibers at scale.

Cellulose is an important structural component of the primary cell wall of green plants, many forms of algae and the oomycetes. See FIG. 1 for specific comparisons of cellulose content by proportion of biomass across various organisms. Cellulose, being one of the most abundant natural polymer on Earth, is present in many objects, both naturally occurring and synthetic, that humans interact with nearly daily. The material is non-toxic, relatively inert, and any form of allergy to cellulose is exceedingly rare. Cellulose can even be harmlessly absorbed by pores in the skin. KBC is ideal to use in the cosmetics industry due to its purity and its smaller dimensions, which facilitate absorption into the skin.

BC fibers offer distinct material properties such as high length to width ratio, high water retention, high crystallinity index, high purity, and customizable surface chemistry that are unlike plant based cellulose. The chemical structure of BC is identical to its plant counterpart which is typically purified during the Kraft process. Specifically, BC is a linear polysaccharide chain consisting of D-glucose units connected by beta-linkages on the order of hundreds to thousands of units long.

BC fiber structure is considered ultra fine and ribbon-shaped with a width of 0.1-0.01 micrometers (obtained using SEM) or approximately 100 times thinner than plant cellulose (Bäckdahl, Henrik et al., 2005; Abitbol, Tiffany, et al., 2016). While orders of magnitude finer than plant cellulose fiber, BC fiber exhibits similar fiber lengths of around 2-0.1 mm when compared with plants fiber lengths ranging from 2-0.8 mm (Choi et al., 2020; Ververis et al., 2003). Due to the fine nature of BC, the polar fiber possesses a high water retention two to three orders of magnitude larger than typical plant cellulose fibers (Karippien, 2017; Ververis et al., 2003). Additionally, the crystallinity index is higher (67-96%) (Andritsou et al., 2018; Dima et al., 2017). This crystallinity index is in aspects attributable to the purity of BC. There also exist other nanoscale cellulose fibers derived from plant matter that exhibit similar nano properties which are typically referred to as MFC. Since MFC is plant derived cellulose it initially contains other biopolymers such as lignin, hemicellulose, and pectin.

Typically, plant matter undergoes a purification process known as the sulphate or Kraft process to remove the biopolymer impurities lignin, hemicellulose, and pectin in order to produce paper pulp. In cases, this purification aspect of the Kraft process accounts for around 50% of the pulping operation's energy consumption. At the magnitude of this industry the Department of Energy estimated that for the United States in 2006, 500 trillion BTU's (an energy equivalence of 90M barrels of oil) was used for chemical preparation and recovery in the pulping process alone (Jacobs, 2006). While chemical recovery has improved, noxious chelating agents, chlorates, and dioxins can still be discharged in effluent from pulp mills which disproportionately affect local communities. In 2015, the Environmental Protection Agency (EPA) estimated that the paper and pulp industry accounted for 20% of all toxic air emissions in the United States (EPA, 2017). Compounded on top of the energy and environmental costs, the chemical refinement also degrades the cellulose reducing yield by up to 50% (EPA, 2017; Broten, 2012). As described herein, it is an object of the present invention to implement small quantities of BC to the paper manufacturing process to, in part, reduce the environmental burden plant matter pulp conversion carries, as well as extend the longevity and proportion of recycled fibers in paper while producing mechanically improved end paper products.

Traditionally, the SCOBY formed on top of the Kombucha culture is a discarded waste product of Kombucha fermentation. However, the SCOBY is considered a high quality and high purity form of bacterial cellulose that is constructed from a woven mesh of crystalline cellulose tendrils measuring nanometers in diameter and with an unknown length, thought to be in micrometers, giving the SCOBY strength. It is an object of the present invention to show unique growth, manufacturing and treatment processes, as described herein, to enable the KBC to be used in many potential industries, including but not limited to, paper and packaging, biomedical and pharmaceuticals, food and cosmetics, biosensors and energy storage, and/or textiles and materials.

Cellulose is also an edible, inert organic that is used in food packaging and as filler in food products to bolster volume, fiber content of food and preservation. Fiber is of significant nutritional benefit for its positive effect on the digestive tract and the potential improvement to internal regulation of sugar and cholesterol as the fiber passes through the human body. Cellulose, being extremely rich in dietary fiber, aids in metabolism and can bond to excess sugars and cholesterol in the bloodstream, effectively regulating internal body conditions for overall improved health and metabolism.

KBC has unique properties and dimensions compared to the standard accepted values for typical plant-based fiber types. The Fiber Properties chart in FIG. 1 is based off of published research gathered from an array of sources. The chart demonstrates a diverse set of selected fiber bearing organisms, many of which can be used for manufacturing. Note that many factors such as climate, age of organism at time of harvest, and part of organism harvested all have significant impact on the exact dimensions reported. There is also limited published research on the full morphology of many fiber-bearing organisms; as such, different sources, spanning individual studies and methodologies, have been surveyed to construct the chart. Given the variable methodology and ranges of errors, note that this graphic does not include error analysis of any values, nor is it a comprehensive study of all fiber bearing organisms. Note also that even most peer reviewed studies disagree on average measurements significantly and as such, methodologies were chosen by the inventors for accuracy and information availability to be included on this chart based on what data determined to be the most reliable. Blank spaces on the graphic are present due to lack of credibly published research on certain values. All values provided are averages, spanning many individual studies, each with many individual test cases. Pulp and paper industry standards for the derived values present in the chart have been applied to a coloration schema which demonstrates which fiber sources are traditionally considered "suitable for pulp/papermaking" though these guidelines are not without exception. The purpose of the graphic is to demonstrate the irregularity of the KBC fiber products according to the current invention.

As further noted in the chart, while distinct values are given, many of these values are subject to change depending on environmental factors such as climate, geography, soil and water quality/availability before harvesting, age of organism at time of harvest, and even by what part of the organism (such as harvesting stalks vs. bast fibers, or the diametric distance from the center of a cross section of logwood) or height along the length of the organism (bottom of a tree vs. top of a tree) the fiber sample is taken from. Because the growth conditions of Kombucha SCOBY can be controlled, the properties of the resulting KBC can be kept consistent or highly consistent and is tunable depending on the conditions provided. The growth conditions of the KBC has several variables that can be modified, including but not limited to nutrient substrate, carbon source, temperature, humidity, gas content, pH, microorganism selection, growth time, light exposure, and sound frequency.

BRIEF DESCRIPTION OF THE DRAWINGS

The accompanying drawings illustrate certain aspects of some of the embodiments of the present invention and should not be used to limit or define the invention. Together with the written description the drawings serve to explain certain principles of the invention.

FIG. 1 is a chart showing fiber properties as indicated.

FIG. 2A shows an example of how Kombucha-derived Bacterial Cellulose impacts the tensile strength of paper.

DETAILED DESCRIPTION OF VARIOUS EMBODIMENTS

Figure 2B:
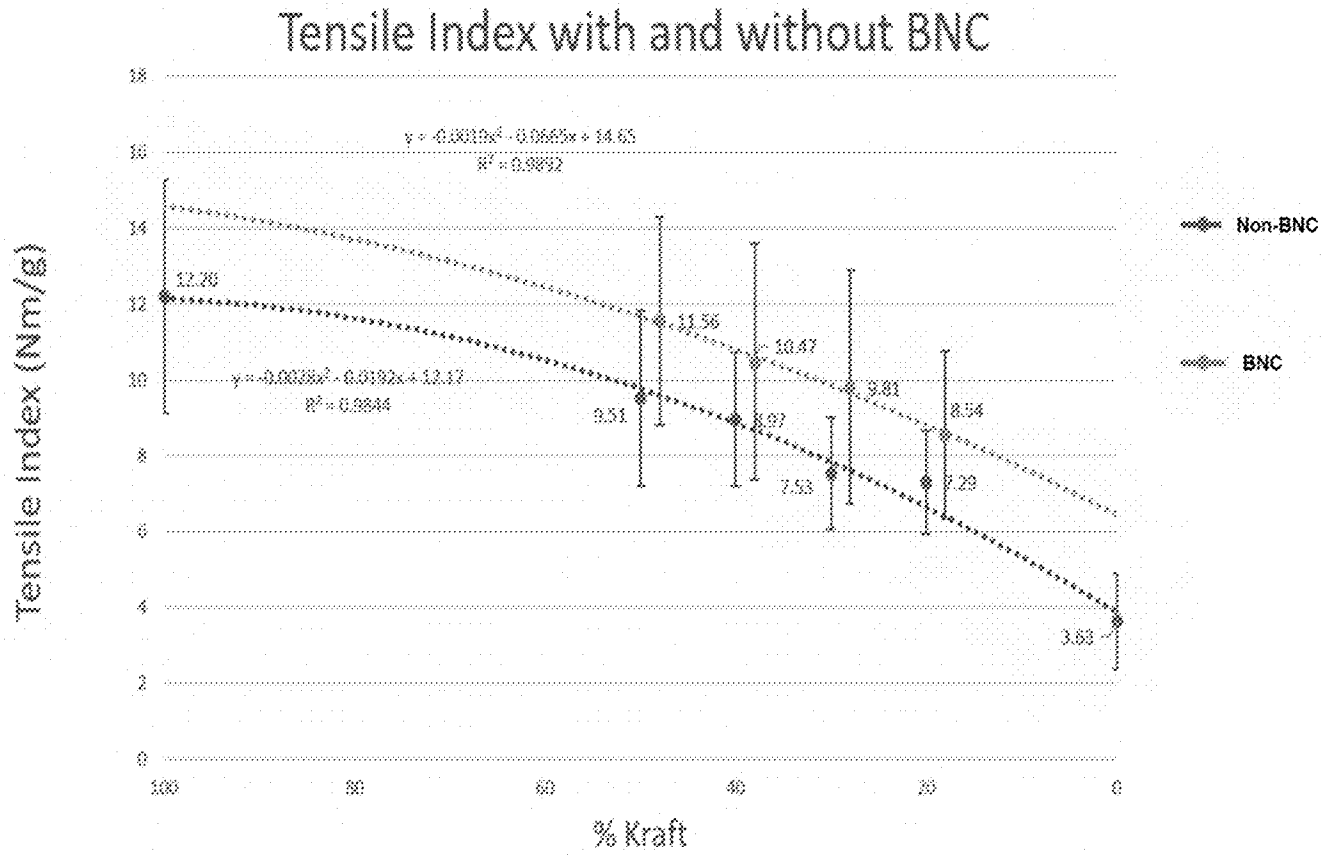
FIG. 2B shows an example of average tensile index for 10 samples of both BNC-treated and untreated papers plotted according to decreasing Kraft fiber percentage and increasing recycled cardboard content.

The present invention has been described with reference to particular embodiments having various features. It will be apparent to those skilled in the art that various modifications and variations can be made in the practice of the present invention without departing from the scope or spirit of the invention. One skilled in the art will recognize that these features may be used singularly or in any combination based on the requirements and specifications of a given application or design. Embodiments comprising various features may also consist of or consist essentially of those various features. Other embodiments of the invention will be apparent to those skilled in the art from consideration of the specification and practice of the invention. The description of the invention provided is merely exemplary in nature and, thus, variations that do not depart from the essence of the invention are intended to be within the scope of the invention.

The structural integrity of Kombucha cellulose provides improvements to many existing fiber products by enhancing desirable properties including but not limited to tensile strength, burst strength, air permeability, mold-free shelf life, hydrophobicity and porosity. The present invention relates to the production and use of specialty cellulose and cellulose derivatives using the SCOBY (Symbiotic Colony of Bacteria and Yeast) produced as the side stream of Kombucha fermentation, collectively known as Kombucha-derived Bacterial Cellulose (KBC). After the cultivation of KBC from Kombucha SCOBY, a harvesting, processing, purifying, and packaging process allows for the generation of a new value-added fiber product in the form of a fiber additive.

Fiber products is a term encapsulating packaging and paper industry products involving cellulose including but not limited to, food additives and/or edible food packaging, such as for sausage casing or edible filler material used in food product manufacturing, fiberboard products, such as cardboard, and cosmetic applications.

While both Kombucha fermentation and cellulose production have been known for several hundred years, the current innovation described herein is the novel and non-obvious combination of these at least two processes in order to create a specialty cellulose and cellulose derivatives. Additionally, the use of Kombucha SCOBY as a fiber product substrate or as an additive to fiber product substrates presents several unexpected advantages that lead to the development of a superior fiber product, such as the small nanofibers which can intercalate themselves between the larger fibers of traditional plant based cellulose, or other polymers, reducing the porosity, altering the barrier properties, and increasing tensile strength, along with a host of other properties. The ability of Kombucha based Bacterial Cellulose to create these complex web formations with traditional plant based cellulose or other polymers is unexpected because the highly acidic nature of Kombucha is traditionally a force that dissolves and breaks apart formations. Here we see that the fiber bonding and intercalation is extremely prolific when innovative approaches herein allow for the displacement of the acidic environment with a more neutral environment. The acidic environment is a distinct disadvantage that requires innovative approaches to overcome as described herein and are aspects of the current invention. An innovative approach is, in one possible embodiment of the current invention, 1) removing the SCOBY biofilm from the Kombucha culture, 2) processing that SCOBY biofilm into fibers of desired dimensions while retaining their properties, and 3) replacing the solvent to remove acids, organics, heavy metals, and/or other molecules that would interfere with the bonding of the Kombucha fiber, but without disturbing the intrinsic properties of the Kombucha fiber itself. Thus, the present invention demonstrates an innovative synthesis and use of Kombucha SCOBY to enhance the properties of fiber products using a fiber additive made from bacterial cellulose derived from the SCOBY biomass.

A batch of Kombucha contains, in embodiments: (1) at least one beneficial yeast, (2) *acetobacter* (a beneficial bacteria in the SCOBY), (3) gluconic acid (a pH regulator), and (4) acetic acid (an antimicrobial acid, which also stabilizes blood sugar). Most batches of Kombucha will also contain an analgesic (pain reliever), an anti-arthritic compound, an antispasmodic compound, a liver-protective compound, and several antibacterial compounds. The final (resultant) Kombucha SCOBY fiber additive product contains a blend of beneficial bacteria and yeast (probiotics) as well as certain acids, enzymes, vitamins and other nutrients that aid digestion, detoxify the body, and promote an efficacious impact on health.

Bacterial Cellulose refers to the biofilm created by microbial cultures upon conversion of a nutrient substrate during the fermentation process. While traditional Bacterial Cellulose is grown using very limited substrates, Kombucha is a robust organism and can be trained to grow Kombucha-derived Bacterial Cellulose (KBC) using various substrates, including but not limited to: tea, coffee, red wine, white wine, malts/beers, and residual juices from fruits (e.g., tangerine or lime), vegetables, coconut milk, or other organic matter. In another aspect, the novel fiber product additive further comprises at least one chemical or ingredient selected from: a flavorant, a colorant, a vitamin, or a combination thereof. The flavorant may be selected from: beet juice, lemon juice, mint, or another natural fruit or vegetable flavor, in aspects. In another aspect, the color of the fiber product additive is selected from: tan (e.g., derived from black tea substrate), purple (e.g., derived from red wine substrate), white (e.g., derived from white wine substrate), or a combination thereof. In another aspect, the fiber product additive is flavored by other additives in the Kombucha. For example, Kombucha can be flavored by both natural and synthetic ingredients or components, including but not limited to beet juice, lemon juice, mint, or any other fruit/vegetable, or organic product. In another aspect, the fiber product additive further comprises a vitamin, a mineral, a botanical, or a combination thereof. Examples of vitamins include: B12, A, C, D, and E. Examples of botanicals include: acai, green tea, black tea, and grape seed.

The fiber additive derived from the Kombucha SCOBY may be produced by growing and harvesting microbial cellulose via the procedures described in the related patent application publication no. 2019/0174815, which is hereby incorporated by reference herein. Additionally, to purify this additive and prepare it for varied uses as a versatile fiber additive, additional steps may be taken to assure product quality and regularity. Such additional steps may include the removal of impurities, such as proteins, fats, nucleic acids, and heavy metals, and the balancing of pH. The process influences the properties of the final fiber additive product and is designed to generate resultant properties that are, in aspects, non-volatile, consumer safe, and highly pure, and which retain as many of the positive natural properties of KBC as possible.

Example 1

When used as a fiberboard additive in a paper product, such as cardboard or construction paper, the product may further comprise 0.1-5% by weight of a paper additive, other than the Kombucha SCOBY fiber, selected from calcium carbonate, formation aid PEO (polyethylene oxide), lime, soda ash, coagulant, kaolin clay, flame retardant, gelatin sizing, sizing, methyl cellulose, or a combination thereof. When adding Kombucha Fiber, the fiber composition may be calculated by considering the weight of wet SCOBY that must be added to a fiber blend, such that 1 kg of SCOBY added to 99 kg of other fiber or polymers constitutes 1% w/w (weight by weight or weight per weight), by example or illustration. Additionally, the fiber composition may be considered as the addition of dry Kombucha fiber that must be added to a fiber blend, such that 1 kg of Kombucha Fiber added to 99 kg of other fiber or polymers constitutes 1% w/w. Additionally, the composition of a paper additive, as described above, may be considered as the weight of the paper additive that is added to a total fiber blend, such that 1 kg of paper additive in 99 kg of total fiber, comprised of Kombucha fiber, SCOBY, other fibers and/or polymers, yields 1% w/w. Similarly, any of the above compositions may be calculated as weight by volume, such that 1 kg SCOBY, Kombucha fiber, or paper additive, when added to 100 L of solution, yields 1% w/v (weight by volume). The solution in question can be water or water that has already been combined with other fiber or polymers, in aspects.

In another aspect, when used as a fiberboard additive in a cardboard product, the Kombucha fiber additive may increase the proportion of recycled fiber usable and decrease the proportion of virgin fiber needed. In another aspect, when used as a fiberboard additive in a cardboard product, the Kombucha fiber additive may increase the mechanical and barrier properties of the cardboard.

Example 2

KBC, when used as a fiber additive in a food casing, filler, hard form consumable, soft form consumable, and/or ice nucleation agent, helps in preservation of food. When used as a fiber additive in a food casing, the KBC fiber additive incorporates various biologics to prevent spoilage and/or to maintain improved, ideal or near ideal conditions. In another aspect, when used as a fiber additive in a food casing, the Kombucha fiber additive affects the material properties of the casing by inciting bacterial resistance to pathogens including but not limited to *Escherichia coli, Staphylococcus aureus*, and *Bacillus subtilis*. When used as a fiber additive in a food casing, the Kombucha fiber additive imparts the following impactful properties: tensile strength, in situ moldability, water holding capacity, biocompatibility and biodegradability, porosity, crystallinity, air permeability, fibre length, and fiber diameter. In another aspect, when used as a fiber additive in a food product or casing for a food product, the Kombucha fiber additive is an edible, non-toxic additive to food or food packaging which provides nutritional value and is food safe. Microcrystalline cellulose has been shown to provide positive effects on gastrointestinal physiology, and hypolipidemic effects, influencing the expression of enzymes involved in lipid metabolism, as well as benefits to metabolic pathways based on the dietary fiber content of KBC. Additionally, synthetic sweeteners can be absorbed by the fiber additive which can then be used as a carrier for a wide variety of frozen and other foodstuffs.

Example 3

In another aspect of the present invention, when used as a fiber additive in a cellulosic fiber based surface coating for packaging, the Kombucha fiber additive enhances barrier properties such as air permeability, water vapor permeability, moisture barrier properties, porosity, hydrophobicity, thermal insulative stability, burst strength, compression strength, tensile strength, elongation, tear strength, stiffness, elastic modulus, smoothness, electrostatic stability, and/or radiation absorption, and improves shelf life and stability.

Example 4

In another aspect of the present invention, when used as a fiber additive in a hydrocarbon surface coating (synthetic bio-polymer including but not limited to Polylactic acid (PLA), Polyhydroxyalkanoates (PHA), Polyhydroxybutyrate (PHB), etc., which has been mechanically introduced to the Kombucha fiber additive), the Kombucha fiber additive enhances barrier properties in addition to those cited in FIG. 3, such as adhesion between layered bioplastics. Thermoplastic corn starch (TPCS) films, a relative standard for U.S. industry practices, require the addition of plasticizers in specific quantities to produce appropriate barrier properties, though the addition of nanobiocomposites such as KBC can compensate for these property specifications. Bio polymers manufactured by casting have drying times much longer than are industrially/commercially viable and in most cases films cannot be produced using industrial processes by means of extrusion, melt-mixing or other processing equipments because they are not thermoplastic materials and they can be degraded during thermal processing. Despite these complications, BC can be used according to the present invention to improve the properties of hydrocarbon coatings in a variety of packaging and food packaging applications.

Example 5

In another aspect of the present invention, when used as a fiber additive in synthetic fabric products, such as for textiles in garments, speaker technology, medical sutures, and industrial cloth or rope made from cellulose, the Kombucha fiber additive as described herein imparts mechanical resistance, dimensional stability, tension resistance, lowered weight, enhanced durability, absorption in a hydrated state, enhanced water retention capacity, selective porosity, enhanced resistance when humid, and enhanced capacity of retention with regards to the surface-volume relation.

Example 6

In another aspect of the present invention, when used as a fiber additive in synthetic leather products, the unique Kombucha fiber additive imparts insulative capabilities and unique texture. Further, the Kombucha SCOBY can be conditioned to form a leather like material on its own. The steps involved, in aspects, include solvent exchange with the Kombucha SCOBY to remove acids, organics, salts, and/or other impurities. The SCOBY can be simultaneously dehydrated while one or a variety of oils and/or waxes are applied to maintain its malleability. As the SCOBY dries, the material can be mechanically worked (e.g., rigorously mechanically worked) and/or manipulated to impart elasticity, durability, and/or longevity to the material.

Example 7

In another aspect of the present invention, when used as a fiber additive in medical grade wound dressings and bandages the KBC can enhance tensile properties, water holding capacity, biocompatibility, and porosity and permeability to gases, allowing them to maintain a suitable moist environment, and to absorb wound exudates. Additionally, KBC has a liquid storage capacity impactful for the transference of medically significant liquids (note U.S. Pat. No. 4,588,400, hereby incorporated by reference herein), such as cyclosporin to reduce risk of implant rejection, antimicrobial, antiviral, and antifungal agents for wound dressing, or other pertinent drugs to aid in the effectiveness of a wound dressing. The liquid storage capabilities of the fiber additive can be used for this task as the liquid held within the fiber additive is slowly dispersed throughout the environment by processes requiring no additional mechanization, instigation, bioengineering, or administering of chemicals or additional chemicals.

Example 8

In another aspect of the present invention, when used as a fiber additive in growth media substrate, a degree of dispersion of submicron hydrophilic cellulose fibers provides a superior growing medium for both plant and animal tissues, partially due to the constant water supply coupled with air permeability that allows root hairs to breath and remain hydrated (not drown) and partially due to structural stability. The same characteristics enable KBC gels to perform as seed coatings which can be engineered to space out seeds within a prefab membrane. In similar agricultural systems, KBC can be injected with fertilizers, pesticides, etc. and slowly disperse them throughout the environment while being resistant to viruses and pathogens.

Example 9

In another aspect of the present invention, when used as a fiber additive in biofiltration sponges, the surface area of the fiber additive enables increased holding capacity and rate of absorption of the biofilter, particularly in vapor populated environments. Dimensional stability with regards to high or extreme temperatures including hot water are of particular benefit to this particular embodiment of the invention.

Example 10

In another aspect of the present invention, the invention described herein can be used as a fiber additive in insulation, such as aerosolized spray insulation for construction projects, wherein the additive imparts non-toxicity or less toxicity, a degree of biodegradability, insulative properties, and homogeneity of the insulation product.

Example 11

In another aspect of the present invention, when used as a fiber additive in cosmetic skin care products such as lotions, moisturizers, and makeup, the Kombucha fiber creates a stable oil-in-water emulsion that does not cause skin irritation, provides a high degree of hydration and can penetrate pores without damaging or poisoning the user. KBC can be beneficial to hair appearance, body, and feel due to submicron association of KBC fibrils in large quantities with hair follicles. Similarly in cosmetic applications, the fiber additive's liquid holding capacity and natural dispersal process allows the fiber additive to carry skin treating compounds, wrinkle treating or removing compounds, other drugs, emoluments, hair treatments, and hormones for the skin.

Example 12

In another aspect of the present invention, the invention can be used as a fiber additive in resins, gums, and gels, including but not limited to examples such as Xanthan and alginate, which individually have many industrial applications. In these embodiments of the fiber additive, resultant increase in strength properties and flexibility can be achieved.

Example 13

In another aspect of the present invention, the invention can be used as a fiber additive to create or be added as a component/ingredient of any of the following: Labels, Cards, Paperboard Boxes, Wrapping Paper, Tissue Paper, Receipts, Specialty Paper, Coated Papers, Leather, Waterproofing Papers, Kitchen Paper Products (napkins, paper plates), Cover Paper, Film Sheets, Sketching/Art Paper, Adhesive Stickers, Coffee Filters, Vapor Filters, Wallpaper, Clothing, Raincoat Ponchos, Folders, Office Supplies, School Supplies, Waterproof Leather Sheets, Retail products (barcode labels, price tags), Paper Bags (wine gift bags, grocery bags), Film Paper, Contact Paper, Bottle labels, Poster Boards, Paper Box, Corrugated PaperBoard, Folding Paper Cartons, Sticky Notes, Notepads, Toilet Roll, Paper Roll, Construction materials, Insulation, Tea Bags, Tobacco & Marijuana Industry paper products, Cigarette Papers, Cigarette Rolling Papers, Paper Towels, Paper Packaging, Tissues, Paper Cups, Artisan craft paper, Smoke Filters, Air Filters, Paper Tubes, Specialty Fiber Combinations for Artisan Purposes, Interior Design, Gift Packaging, Ribbons, Twine, String, Thread, Shredded Pet Bedding, Furniture/Bedding Pads, Paper Envelopes, Shipping & Packaging, Newsprint Paper, Paper Window Products/Blinds, Paper Lamp Shades, Plant-based Baskets, Bond Paper/Legal Documents, Letterheads/Business Contract/Resume Paper, Social Correspondence Paper, Wedding Stationery/Invitation Paper, Translucent Tracing Paper, Parchment, Vellum, Backing Paper, Doilies, Patterned Paper, Decoupage Paper, Scrapbooking Paper, Origami Paper, Brown Paper, Curtains, Construction Paper (Sheathing Paper, Roofing, Floor Covering, Sound Proofing, Industrial, Similar Felts, Sheathing Paper, Insulation, Decorative Finishes for Wall), Air Freshener Paper, Perfume Paper/Tester, Scent Paper, Crepe Paper, Art Tissue Paper & Streamers, Containerboard, Clipboard, Cover Paper (Embellished Paper, Heavy Paper, Book Covers, Catalogues, Brochures, Pamphlets), Woven Paper, Paint Canvas, Paint Fabric Swatches, Interleaved/Perforated/Crosshatched/Watermarked Paper, Food Wrappers, Food Box Containers, Bible/Book Papers, Coated Papers, Facial/Cosmetic Papers, Makeup Paper Wipes, Feminine Hygiene Products, Wallboard, Pressure-Sensitive Contact Film Paper, Cloth Bags, Medical Paper Products, Gauze, Bandages, Paper Gowns, Paper Masks, Paper Hair Caps, Paper Tape, Paper Toilet Seat Covers, Medical Paper Pouch/Sachets, Disposable Paper, Medical Crepe Paper, Plotter Paper/Roll Tape Paper, Microfilters, Dental Fiber Rolls, Fiber Balls, PH Indicator Paper Strips, Cupcake Cup Liners, Graph Paper, Architecture Drafting Paper, Calligraphy Paper, Baking Parchment Paper, Food Paper Liners/Container/Tray Liners, Wax Paper Liners, Food/Deli Wrapping Paper, Pet Cardboard Houses, Pet Paper Litter, Sandpaper, Adhesive Lint Roller Paper, Laminated Paper, Paper Dollhouses, Paper Toys, Photo Paper, Paper Placemats, Paper Coasters, Cup Sleeve Holders, Journals, Planners, Art Prints, Stamps, Gift Cards, Maps, Business Cards, and/or Masking/Art/Painting Tape.

Example 14

In another aspect of the present invention, KBC can be used in whole or as an additive to create or act as a component/ingredient of hydrogels.

FIG. 2A shows an example of how Kombucha-derived Bacterial Cellulose impacts the tensile strength of paper. FIG. 2A shows the matrix of average GSM (grams per square meter) and average maximum tensile force before failure in Newtons of sheets of varying composition, both with and without the addition of BNC.

FIG. 2B shows an example of average tensile index for 10 samples of both BNC-treated and untreated papers plotted according to decreasing Kraft fiber percentage and increasing recycled cardboard content. The analysis was conducted on the raw data and averages to control for GSM variation. As seen in FIG. 2B, the tensile index for paper is calculated by dividing the average maximum tensile force by the specimen width (2.54 cm) and then dividing by the average GSM. This assumes a linear correlation between GSM and tensile force and is regularly used by the paper industry. The horizontal axis is demarcated by the percentage dry weight of kraft fiber in each of the sheets. Two separate groups of data are apparent and represent the tensile indexes of recycled cardboard vs. kraft fiber percentage for samples with and without the two percent BNC addition. Plotting a second order polynomial regression for each data set displays a 0.98 R-squared value for each data set indicating a fit between the regression and the empirical data. The polynomial regression for each data set obtained a higher R-squared than linear regressions. This implied non-linear relationship demonstrates that improved fiber quality furnish can improve tensile strength up to a point before other formation factors have greater impact on mechanical integrity. Noticeably, the BNC additive curve is always above the non-BNC additive curve which suggests that the addition of BNC fiber contributes to an increased tensile strength even while linearly controlling for GSM through tensile indexing. This data analysis provides a basis to substantiate the aspect of the invention described herein that the addition of BNC can be used to substitute Kraft fiber with OCC (Old Corrugated Containers) fiber. Additionally, similar horizontal axis values between the two regressions offer insight into the amount of Kraft fiber, in aspects, that can be reduced while maintaining performance. The average tensile index is 0.24 for the 50 percent Kraft fiber sample, and the most similar BNC additive sample has a tensile index of 0.25 and contains 28 percent Kraft fiber. Similarly, another horizontal grouping of non-BNC and BNC samples each shows a tensile index of 0.23 and 0.24, respectively. The Kraft content for each sample set is 40 percent and 18 percent, respectively. These results demonstrate that by using the manufacturing methods employed, the tensile index (and other correlated mechanical properties) can be enhanced with, in aspects, minor addition of BNC to substitute up to 20 percent dry weight Kraft fiber with OCC fiber, by way of example only. It is shown in the particular case that the 100 percent Kraft paper exhibits a similar tensile index at 0.31 to the tensile index of the 48 percent Kraft paper that includes the BNC additive. This information suggests that fiber substitution could be higher. In other aspects, the fiber substitution could be lower.

In aspects, the fiber product additive can comprise from 0.1% to 20% of the cellulose from the microbe grown in the symbiotic colony of bacteria and yeast (SCOBY) formed during Kombucha culture and/or fermentation.

In aspects, a product comprising the fiber product additive can comprise from 0.1% to 20% of the cellulose from the microbe grown in the symbiotic colony of bacteria and yeast (SCOBY) formed during Kombucha culture and/or fermentation.

In aspects, a paper product comprising the fiber product additive can comprise from 0.1% to 20% of the cellulose from the microbe grown in the symbiotic colony of bacteria and yeast (SCOBY) formed during Kombucha culture and/or fermentation.

In aspects, the fiber product additive can comprise from 20% to 100% of the cellulose from the microbe grown in the symbiotic colony of bacteria and yeast (SCOBY) formed during Kombucha culture and/or fermentation.

In aspects, a product comprising the fiber product additive can comprise from 20% to 100% of the cellulose from the microbe grown in the symbiotic colony of bacteria and yeast (SCOBY) formed during Kombucha culture and/or fermentation.

In aspects, a paper product comprising the fiber product additive can comprise from 20% to 100% of the cellulose from the microbe grown in the symbiotic colony of bacteria and yeast (SCOBY) formed during Kombucha culture and/or fermentation.

In aspects, the fiber product additive is incorporated in or added to a production of a bioplastic, wherein the bioplastic comprises a blend of polymers, wherein the blend of polymers includes one or more of Polylactic acid (PLA), Polyhydroxyalkanoates (PHA), Polyhydroxybutyrate (PHB), chitosan, keratin, and/or cornstarch.

In aspects, a bioplastic comprising the fiber product additive comprises a blend of polymers, wherein the blend of polymers includes one or more of Polylactic acid (PLA), Polyhydroxyalkanoates (PHA), Polyhydroxybutyrate (PHB), chitosan, keratin, and/or cornstarch.

One skilled in the art will recognize that the disclosed features may be used singularly, in any combination, or omitted based on the requirements and specifications of a given application or design. When an embodiment refers to "comprising" certain features, it is to be understood that the embodiments can alternatively "consist of" or "consist essentially of" any one or more of the features. Other embodiments of the invention will be apparent to those skilled in the art from consideration of the specification and practice of the invention.

It is noted that where a range of values is provided in this specification, each value between the upper and lower limits of that range is also specifically disclosed. The upper and lower limits of these smaller ranges may independently be included or excluded in the range as well. The singular forms "a," "an," and "the" include plural referents unless the context clearly dictates otherwise. It is intended that the specification and examples be considered as exemplary in nature and that variations that do not depart from the essence of the invention fall within the scope of the invention. Further, all the references cited in this disclosure are each individually incorporated by reference herein in their entireties and as such are intended to provide an efficient way of supplementing the enabling disclosure of this invention as well as provide background detailing the level of ordinary skill in the art.

REFERENCES

All references cited in this application are incorporated herein by reference, including:

Jessica Martínez Leal, Lucía Valenzuela Suárez, Rasu Jayabalan, Joselina Huerta Oros & Anayansi Escalante-Aburto (2018), A review on health benefits of kombucha nutritional compounds and metabolites, CyTA—Journal of Food, 16:1, 390-399, DOI: 10.1080/19476337.2017.1410499.

Beibei Huang, Jingli Hu, and Jeffrey Rohrer (2016), Determination of Organic Acids in Kombucha Using a High-Pressure Ion Chromatography System—ThermoFischer.

Biljana Bauer-Petrovska, Lidija Petrushevska-Tozi (2001), Mineral and water soluble vitamin content in the Kombucha drink—International Journal of Food Science and Technology, 35:2, DOI: 10.1046/j. 1365-2621.2000.00342.

United States Environmental Protection Agency, Profile of the Pulp and Paper Industry, Second Edition: EPA Office of Compliance Sector Notebook Project (November 2002).

Handbook for Pulp & Paper Technologists, Fourth Edition. Gary Smook, (2016).

Arévalo Gallegos, A. M, Carrera, S H., Parra, R., Keshavarz, T., and Iqbal, H. M. N. (2016) "Bacterial cellulose: A sustainable source to develop value-added products—A review," BioRes. 11(2), 5641-5655.

Geels F W. Regime Resistance against Low-Carbon Transitions: Introducing Politics and Power into the Multi-Level Perspective Theory, Culture & Society. 2014,31(5): 21-40 doi:10 1177/0263276414531627

Jay Daggar. Corrugated board grades explained: types of cardboard. Design & Innovation. (April 2021).

Johanna Kramm, Lukas Sattlegger, Jenny Fuhrmann, David Steinwender. Sustainable Transformation of Food Distribution Systems—Research and Practice in a Transdisciplinary Discussion. Institute for Social-Ecological Research. (May 2018).

DHL Trend Research. Rethinking Packaging—A DHL perspective on the future of packaging in the logistics industry.

Peter Berg, David Ferber, Anna Granskog. The drive toward sustainability in packaging-beyond the quick wins. Mckinsey & Company. (January 2020).

Mark Williamson. Microcellulose gains footholds in paperboard (January 2017).

Todd Bukowski and Michael Richmond. A Holistic View of the Role of Flexible Packaging in a Sustainable World. The Flexible Packaging Association. (April 2018).

Balea A, Fuente E, Monte M C, et al. Industrial Application of Nanocelluloses in Papermaking: A Review of Challenges, Technical Solutions, and Market Perspectives. Molecules. 2020;25(3):526. Published 2020 Jan 25. doi: 10.3390/molecules25030526.

Isko Kajanto, Mike Kosonen. The potential use of Micro- and Nano-Fibrillated Cellulose as a reinforcing element in paper Journal of Science & Technology for Forest Products and Processes: VOL.2, NO.6, 2012.

Zambrano, F., Starkey, H., Wang, Y., Abbati de Assis, C., Venditti, R., Pal, L., Jameel, H., Hubbe, M. A., Rojas, O. J., and Gonzalez, R. (2020). "Using micro- and nanofibrillated cellulose as a means to reduce weight of paper products: A review," BioRes. 15(2), 4553-4590.

Wiltrud Terlau, Nicolas Fuchshofen, Johannes Klement Ecological Comparison of the Use of Sulphate Pulp. Wastepaper Material, and Grass-Based pulp in German Paper Production. (June 2017).

H. P. S, A. K., Saurabh, C. K., A. S., A., Nurul Fazita, M., Syakir, M., Davoudpour, Y., . . . Dungani, R. (2016). A review on chitosan-cellulose blends and nanocellulose reinforced chitosan biocomposites: Properties and their applications. Carbohydrate Polymers, 150, 216-226. doi: 10.1016/j.carbpol.2016.05.028.

Zahan, K. A., Azizul, N. M., Mustapha, M., Tong, W. Y., Abdul Rahman, M. S., & Sahuri, I. S. (2020). Application of bacterial cellulose film as a biodegradable and antimicrobial packaging material. Materials Today: Proceedings, 31, 83-88. doi: 10.1016/j.matpr.2020.01.201.

Azeredo, H. M., Barud, H., Farinas, C. S., Vasconcellos, V. M., & Claro, A. M. (2019). Bacterial cellulose as a raw material for food and food packaging applications. Frontiers in Sustainable Food Systems, 3. doi: 10.3389/fsufs.2019.00007.

Padrão, J., Gonçalves, S., Silva, J. P., Sencadas, V., Lanceros-Méndez, S., Pinheiro, A. C., . . . Dourado, F. (2016). Bacterial cellulose-lactoferrin as an antimicrobial edible packaging. Food Hydrocolloids, 58, 126-140. doi: 10.1016/j.foodhyd.2016.02.019.

Gallegos, A. M., Herrera Carrera, S., Parra, R., Keshavarz, T., & Iqbal, H. M. (2016). Bacterial cellulose: A sustainable source to develop value-added products—a review. BioResources, 11(2). doi: 10.15376/biores.11.2.gallegos.

Dima, S., Panaitescu, D., Orban, C., Ghiurea, M., Doncea, S., Fierascu, R., . . . Oancea, F. (2017). Bacterial nanocellulose from Side-Streams of Kombucha Beverages Production: Preparation and PHYSICAL-CHEMICAL PROPERTIES. Polymers, 9(12), 374 doi: 10.3390/polym9080374.

Jakubek, Z. J., Chen, M., Couillard, M., Leng, T., Liu, L., Zou, S., . . . Johnston, L. J. (2018). Characterization challenges for a cellulose nanocrystal reference material: Dispersion and particle size distributions. Journal of Nanoparticle Research, 20(4). doi: 10.1007/s11051-018-4194-6.

Santos, S. M., Carbajo, J. M., *Quintana*, E., Ibarra, D., Gomez, N., Ladero. M., . . . Villar, J. C. (2015). Characterization of purified bacterial cellulose focused on its use on paper restoration. Carbohydrate Polymers, 116, 173-181. doi: 10.1016/j.carbpol.2014.03.064.

Soleimani, A., Hamedi, S., Babaeipour, V., & Rouhi, M. (2021). Design, construction and optimization of a Flexible Bench-scale rotating biological contactor (RBC) for enhanced production of Bacterial cellulose by *acetobacter Xylinum*. Bioprocess and Biosystems Engineering. doi:10.1007/s00449-021-02510-0.

Costa. C., Medronho, B., Filipe, A., Mira, I., Lindman, B., Edlund, H., & Norgren, M. (2019). Emulsion formation and stabilization by Biomolecules: The leading role of cellulose. Polymers, 11(10), 1570. doi: 10.3390/polym11101570.

Fabra, M. J., López-Rubio, A., Ambrosio-Martin, J., & Lagaron, J. M. (2016). Improving the barrier properties of thermoplastic corn starch-based films containing bacterial cellulose nanowhiskers by means of pha electrospun coatings of interest in food packaging. Food Hydrocolloids, 61, 261-268. doi: 10.1016/j.foodhyd.2016.05.025.

Balea, A., Fuente, E., Monte, M. C., Merayo, N., Campano, C., Negro, C., & Blanco, A. (2020). Industrial application of nanocelluloses in papermaking: A review of challenges, technical solutions, and market perspectives. Molecules, 25(3), 526. doi: 10.3390/molecules25030526.

Bi, J., Liu, S., Li, C., Li, J., Liu, L., Deng, J., & Yang, Y. (2014). Morphology and structure characterization of bacterial celluloses produced by different strains in agitated culture. Journal of Applied Microbiology, 117(5), 1305-1311. doi: 10.1111/jam. 12619.

Azeredo, H. M., Rosa, M. F., & Mattoso, L. C. (2016). Nanocellulose in bio-based food packaging applications. Industrial Crops and Products.

Gao, W., Chen, K., Yang. R., Yang, F., & Han, W. (2011). Properties of bacterial cellulose and its influence on the properties of paper. BioResources.

Yamanaka, S., Watanabe, K., Kitamura, N., Iguchi, M., Mitsuhashi, S., Nishi, Y., & Uryu, M. (1989). The structure and mechanical properties of sheets prepared from bacterial cellulose. Journal of Materials Science, 24(9), 3141-3145. doi: 10.1007/bf01139032.

Brown, M. R.; Microbial cellulose as a building block resource for specialty products and processes therefor. W.O. Patent No. 1989012107A1. 1989 Dec. 14.

Budaeva, V. V., Gismatulina, Y. A., Mironova, G. F., Skiba, E. A., Gladysheva, E. K., Kashcheyeva, E. I., . . . Sakovich, G. V. (2019). Bacterial Nanocellulose Nitrates. Nanomaterials.

Shackford, L. D. (2003). A Comparison of Pulping and Bleaching of Kraft Softwood and *Eucalyptus* Pulps. Tappi. 36th International Pulp and Paper Congress and Exhibition.

Hamaguchi. M., Cardoso, M., & Vakkilainen, E. (2012). Alternative technologies for biofuels production in Kraft Pulp Mills-potential and prospects. Energies, 5(7), 2288-2309. doi: 10.3390/en5072288.

San, H. P., Long, L. K., Zhang, C. Z., Hui, T. C., Seng, W. Y., Lin, F. S., . . . Fong, W. K. (2016). Anatomical features, Fiber MORPHOLOGICAL, physical and mechanical properties of three years Old new Hybrid *Paulownia*: GREEN *PAULOWNIA*. Research Journal of Forestry, 10(1), 30-35. doi: 10.3923/rjf.2016.30.35.

Dima, S., Panaitescu, D., Orban, C., Ghiurea, M., Doncea, S., Fierascu, R., . . . Oancea, F. (2017). Bacterial nanocellulose from Side-Streams of Kombucha Beverages Production: Preparation and PHYSICAL-CHEMICAL PROPERTIES. Polymers, 9(12), 374. doi:10.3390/polym9080374.

Sugesty, S., Kardiansyah, T., & Hardiani, H. (2015). Bamboo as raw materials for dissolving pulp with environmental friendly technology for rayon fiber. Procedia Chemistry, 17, 194-199. doi:10.1016/j.proche.2015.12.122.

Musha, Y., & Goring, D. A. (1975). Cell dimensions and their relationship to the chemical nature of the Lignin from the Wood of broad-leaved trees. Canadian Journal of Forest Research, S(2), 259-268. doi: 10.1139/x75-034.

Jakubek, Z. J., Chen, M., Couillard, M., Leng, T., Liu, L., Zou, S., . . . Johnston, L. J. (2018). Characterization challenges for a cellulose nanocrystal reference material: Dispersion and particle size distributions. Journal of Nanoparticle Research, 20(4). doi: 10.1007/s11051-018-4194-6.

Cabalova, 1., Zachar, M., & Toman, B. (2017). Characterization of thermally loaded woods species in the view of physical-chemical and fire technical properties. International Scientific Conference, Fire Protection, Safety and Security.

Kiaei, M., Tajik, M., & Vaysi, R. (2014). Chemical and biometrical properties of plum wood and its application in pulp and paper production. Maderas. Ciencia Y Tecnologia, (Ahead), 0-0. doi: 10.4067/s0718-221x2014005000024.

Khalil, H. A., Alwani, M. S., Ridzuan, R., Kamarudin, H., & Khairul, A. (2008). Chemical Composition, Morphological Characteristics, and cell wall structures of Malaysian Oil Palm Fibers. Polymer-Plastics Technology and Engineering.

Lukmandaru, G., Zumaini, U. F., Soeprijadi, D., Nugroho, W. D., & Susanto, M. (2016). Chemical properties and FIBER dimension of *Eucalyptus* PELLITA from the 2nd generation of Progeny tests IN Pelaihari, South BORNEO, INDONESIA. Journal of the Korean Wood Science and Technology, 44(4). 571-588. doi: 10.5658/wood.2016.44.4.571.

Sable, L, Grinfelds, U., Jansons, A., Vikele, L., Irbe, I., Verovkins, A., & Treimanis, A. (2012). Comparison of the Properties of wood and Pulp fibers from Lodgepole pine (*Pinus contorta*) as compared to Scots pine (*Pinus sylvestris*). BioResources, 7(2). doi: 10.15376/biores.7.2.1771-1783.

Hurter, R., & Byrd, M. (2013). Considerations for the Use of Nonwood Raw Materials for Tissue Manufacture. Paper Science and Engineering.

Wisconsin, M. S. (1953). Density, fiber length, and yields of pulp for various species of wood. United States Department of Agriculture.

Ververis, C., Georghiou, K., Christodoulakis, N., Santas, P., & Santas, R. (2004). Fiber dimensions, lignin and cellulose content of various plant materials and their suitability for paper production. Industrial Crops and Products, 19(3), 245-254. doi: 10.1016/j.indcrop.2003.10.006.

KIBBLEWHITE, R. P., & HAMILTON, K. A. (1984). FIBRE CROSS-SECTION DIMENSIONS OF UNDRIED AND DRIED PINUS RADIATA KRAFT PULPS. Pulp and Paper Research Organization of New Zealand, Forest Research Institute.

Anggriawan, R., Karlovsky, P., Hadacek, F., & Splivallo, R. (2017). Microbiological and food safety aspects of tempeh production in Indonesia. Göttingen, Germany: Georg-August-University.

LUNDQVIST, S., GRAHN, T., & HEDENBERG, O. (2005). Models for fibre dimensions in different softwood species. Simulation and comparison of within and between tree variations for Norway and Sitka spruce, Scots and Loblolly pine. Wood Quality Modeling.

Hom, R. A. (1978). MORPHOLOGY OF PULP FIBER FROM HARDWOODS AND INFLUENCE ON PAPER STRENGTH. United States Department of Agriculture.

Danielewicz, D., & Surma-Slusarska, B. (2017). Properties and fibre characterisation of bleached hemp, birch and pine pulps: A comparison. Cellulose, 24(11), 5173-5186. doi:10.1007/s10570-017-1476-6.

Tofanica, B. M., Cappelletto, E., Gavrilescu, D., & Mueller, K. (2011). Properties of rapeseed (*Brassica napus*) stalks fibers. Journal of Natural Fibers, 8(4), 241-262. doi: 10.1080/15440478.2011.626189

Liu, Z., Wang, H., & Hui, L. (2018). Pulping and papermaking of non-wood fibers. Pulp and Paper Processing. doi: 10.5772/intechopen.79017.

Bidin, N., Zakaria, M. H., Bujang, J. S., & Abdul Aziz, N. A. (2015). Suitability of aquatic plant fibers for Handmade papermaking. International Journal of Polymer Science, 2015, 1-9. doi: 10.1155/2015/165868.

Manwiller, F. G. (1972). Tracheid dimensions in rootwood of southern pine. Wood Science, 5(2).

Luostarinen, K. (2012). Tracheid wall thickness And LUMEN diameter in DIFFERENT axial and Radial locations in CULTIVATED *LARIX sibirica* trunks. Silva *Fennica,* 46(5). doi: 10.14214/sf.921.

Martin, J. A., Esteban, L. G., De Palacios, P., & Fernandez, F. G. (2010). Variation in wood anatomical traits of *Pinus Sylvestris* L. between Spanish regions of provenance. Trees, 24(6), 1017-1028. doi: 10.1007/s00468-010-0471-4.

Carrillo, L, Aguayo, M. G., Valenzuela, S., Mendonça, R. T., & Elissetche, J. P. (2015). VARIATIONS IN WOOD ANATOMY AND FIBER BIOMETRY OF *EUCALYPTUS GLOBULUS* GENOTYPES WITH DIFFERENT WOOD DENSITY. Wood Research.

Farsi, M., & Kiaei, M. (2014). WOOD PHYSICAL PROPERTIES AND TRACHEID DIMENSIONS OF NON-NATIVE SOFTWOODS IN IRAN. Cellulose Chemistry and Technology, 48(5-6).

Przybysz, K., Małachowska, E., Martyniak, D., Boruszewski, P., Iłowska, J., Kalinowska, H., & Przybysz, P. (2018). Yield of pulp, dimensional properties of fibers, and properties of paper produced from fast growing trees and grasses. BioResources, 13(1). doi: 10.15376/biores.13.1.1372-1387.

Chen, X, Cui, J., Xu, X., Sun, B., Zhang, L., Dong, W., . . . Sun, D. (2020). Bacterial cellulose/attapulgite magnetic composites as an efficient adsorbent for heavy metal ions and dye treatment. Carbohydrate Polymers, 229, 115512. doi: 10.1016/j.carbpol.2019.115512.

Wan. Y., Wang, J., Gama, M., Guo, R., Zhang, Q., Zhang, P., . . . Luo, H. (2019). Biofabrication of a novel bacteria/bacterial cellulose composite for improved adsorption capacity. Composites Part A: Applied Science and Manufacturing, 125, 105560. doi: 10.1016/j.compositesa.2019.105560.

Erdem, M., Ucar, S., Karagöz, S., & Tay, T. (2013). Removal of Lead (II) ions from aqueous solutions onto activated CARBON derived from Waste Biomass. The Scientific World Journal, 2013, 1-7. doi: 10.1155/2013/146092.

Malik, D. S., Jain, C. K., & Yadav, A. K. (2016). Removal of heavy metals from emerging cellulosic low-cost adsorbents: A review. Applied Water Science, 7(5). 2113-2136. doi: 10.1007/s13201-016-0401-8.

Shen, W., Chen, S., Shi, S., Li, X., Zhang, X., Hu, W., & Wang, H. (2009). Adsorption of cu(ii) and pb(ii) onto diethylenetriamine-bacterial cellulose. Carbohydrate Polymers, 75(1), 110-114. doi:10.1016/j.carbpol.2008.07.006.

Zhu, H., Jia, S., Wan, T., Jia, Y., Yang, H., Li, J., . . . Zhong, C. (2011). Biosynthesis of spherical $Fe_3O_4$/bacterial cellulose Nanocomposites AS adsorbents for heavy metal ions. Carbohydrate Polymers, 86(4), 1558-1564. doi: 10.1016/j.carbpol.2011.06.061.

Cheng, R., Kang, M., Zhuang, S., Shi, L., Zheng, X., & Wang, J. (2019). Adsorption of sr(ii) from water by mercerized bacterial cellulose membrane modified with edta. Journal of Hazardous Materials, 364, 645-653. doi: 10.1016/j.jhazmat.2018.10.083.

Oshima, T., Kondo, K., Ohto, K., Inoue, K., & Baba, Y. (2008). Preparation of phosphorylated bacterial cellulose as an adsorbent for metal ions. Reactive and Functional Polymers, 68(1), 376-383. doi:10.1016/j.reactfunctpolym.2007.07.046.

Ashour, R. M., Abdel-Magied, A. F., Wu, Q., Olsson, R. T., & Forsberg, K. (2020). Green synthesis Of Metal-organic Framework Bacterial Cellulose NANOCOMPOSITES for separation applications. Polymers, 12(S), 1104. doi: 10.3390/polym12051104.

Li, D., Tian, X., Wang, Z., Guan, Z., Li, X., Qiao, H., . . . Wei, Q. (2020). Multifunctional adsorbent based on metal-organic framework modified bacterial cellulose/chitosan composite aerogel for high efficient removal of heavy metal ion and organic pollutant. Chemical Engineering Journal, 383, 123127. doi: 10.1016/j.cej.2019.123127.

LU, M., ZHANG, Y., GUAN, X., XU, X., & GAO, T. (2014). Thermodynamics and kinetics of adsorption for heavy metal ions from aqueous solutions onto surface amino-bacterial cellulose. Transactions of Nonferrous Metals Society of China, 24(6), 1912-1917. doi: 10.1016/s1003-6326(14)63271-4.

LIMA FS: NASCIMENTO CWA, SILVA FBV; CARVALHO VGB; RIBEIRO FILHO MR. 2009. Lead concentration and allocation in vegetable crops grown in a soil contaminated by battery residues. Horticultura Brasileira 27:362-365

The invention claimed is:

1. A fibrous additive comprising cellulose from a microbe grown in a symbiotic colony of bacteria and yeast (SCOBY) formed during Kombucha culture and/or fermentation, wherein the fibrous additive reduces a porosity and increases a tensile strength by at least 2% in a paper product comprising from 0.1% or more to less than 50% of the fibrous additive compared to the paper product without the fibrous additive, and wherein the fibrous additive is incorporated in or added to a production of the paper product.

2. The fibrous additive of claim 1, wherein the fibrous additive incorporated in or added to the production of the paper product imparts two or more deviations from a paper product's physical properties including water retention, shelf stability, air permeability, insulative strength, pathogen resistance, water vapor permeability, moisture barrier properties, porosity, hydrophobicity, thermal insulative stability, burst strength, compression strength, tensile strength, elongation, tear strength, stiffness, elastic modulus, smoothness, electrostatic stability, radiation absorption, shelf life, and/or stability.

3. The fibrous additive of claim 1, further comprising a blend of one or more additional cellulosic fiber types chosen from one or more of hemp, flax, *eucalyptus*, sisal, esparto, bamboo, perennial fibers, softwood fibers, hardwood fibers, rag fibers, rice, and/or cotton.

4. A fibrous additive comprising cellulose from a microbe grown in a symbiotic colony of bacteria and yeast (SCOBY) formed during Kombucha culture and/or fermentation, wherein the fibrous additive reduces a porosity and increases a tensile strength by at least 2% in a product comprising from 0.1% or more to less than 50% of the fibrous additive compared to the product without the fibrous additive, and wherein the product is one of paper, cardboard, paperboard, packaging paper, cigarette paper, food wrappers, bible paper, parchment paper, printer paper, writing paper, or notebook paper.

* * * * *